United States Patent [19]

Ziegler

[11] Patent Number: 5,052,566

[45] Date of Patent: Oct. 1, 1991

[54] ENGINE HOIST AND SUPPORT APPARATUS

[76] Inventor: Geoff Ziegler, 215 21st St. SE., Massillon, Ohio 44646

[21] Appl. No.: 619,387

[22] Filed: Nov. 29, 1990

[51] Int. Cl.[5] ..... B66C 7/00; B66C 23/26

[52] U.S. Cl. ..... 212/257; 212/265; 212/260; 212/244

[58] Field of Search ..... 212/255, 257, 265, 227, 212/231, 232, 244, 238, 239, 254

[56] References Cited

U.S. PATENT DOCUMENTS

| | | | |
|---|---|---|---|
| 258,403 | 5/1882 | Frisbie | 212/244 |
| 703,444 | 7/1902 | Murphy | 212/265 |
| 800,723 | 10/1905 | Curtis | 212/244 |
| 1,128,569 | 2/1915 | Arnold | 212/244 |
| 2,858,946 | 11/1958 | Breed | 212/244 |
| 3,275,296 | 9/1966 | Meyer | 212/265 |
| 4,090,625 | 5/1978 | Walters | 212/265 |
| 4,749,324 | 6/1988 | Rulison | 212/265 |

FOREIGN PATENT DOCUMENTS

| | | | |
|---|---|---|---|
| 2566379 | 12/1985 | France | 212/182 |

*Primary Examiner*—Joseph F. Peters, Jr.
*Assistant Examiner*—R. B. Johnson
*Attorney, Agent, or Firm*—Leon Gilden

[57] ABSTRACT

An apparatus including a central vertical support post, including a plurality of support legs orthogonally mounted to a lower end of the support post. The support post pivotally mounts a support boom at an upper end thereof, with a rear terminal end of the support boom including a plurality of chain members, with lower ends of the chain members mounted to a lower chain support beam that is orthogonally mounted to a telescoping portion of a jack member. The apparatus includes an engine support plate mounted upon a forward face of the support post. A modification of the invention includes the support post oriented at an obtuse angle relative to the support legs pivotally mounting the support boom at a rear terminal end of the support boom, with the jack member positioned medially of the support boom between the support boom and the engine support plate.

9 Claims, 6 Drawing Sheets

PRIOR ART

ENGINE HOIST AND SUPPORT APPARATUS

BACKGROUND OF THE INVENTION

1. Field of the Invention

The field of invention relates to lifting apparatus, and more particularly pertains to a new and improved engine hoist and support apparatus wherein the same provides for a sequential or alternative lifting and support of an engine subsequent to its positioning by the hoist organization.

2. Description of the Prior Art

The lifting and support of various engine components has been utilized in the prior art. Heretofore, an engine subsequent to being removed from an associated support organization is subsequently repositioned for mounting onto an engine support stand and the like. The instant invention attempts to overcome deficiencies of the prior art by providing a mounting plate for the engine positioned in alignment and rearwardly of a track portion of a support boom of the organization to permit rearward movement of the engine along the support boom for mounting upon the engine support plate of the same organization. Examples of the prior art include U.S. Pat. No. 4,770,304 to Woods wherein an engine hoist includes a retractable upper boom to permit repositioning of an engine relative to the boom for ease of manipulation of the organization.

U.S. Pat. No. 4,508,233 to Helms provides a lifting organization setting forth a further example of a telescoping boom construction.

U.S. Pat. No. 4,782,962 to Hackworth provides for a lifting organization that may be portably mounted to an individual by a backpack arrangement to transport the lifting organization to an elevated position such as a roof.

As such, it may be appreciated that there continues to be a need for a new and improved engine hoist and support apparatus which addresses both the problems of ease of use as well as effectiveness in construction and in this respect, the present invention substantially fulfills this need.

SUMMARY OF THE INVENTION

In view of the foregoing disadvantages inherent in the known types of engine hoist apparatus now present in the prior art, the present invention provides an engine hoist and support apparatus wherein the same provides for a track mounted lifting carriage mounted within the boom for permitting repositioning of the engine subsequent to its lifting by the organization. As such, the general purpose of the present invention, which will be described subsequently in greater detail, is to provide a new and improved engine hoist and support apparatus which has all the advantages of the prior art engine hoist apparatus and none of the disadvantages.

To attain this, the present invention provides an apparatus including a central vertical support post, including a plurality of support legs orthogonally mounted to a lower end of the support post. The support post pivotally mounts a support boom at an upper end thereof, with a rear terminal end of the support boom including a plurality of chain members, with the lower ends of the chain members mounted to a lower chain support beam that is orthogonally mounted to a telescoping portion of a jack member. The apparatus includes an engine support plate mounted upon a forward face of the support post. A modification of the invention includes the support post oriented at an obtuse angle relative to the support legs pivotally mounting the support boom at a rear terminal end of the support boom, with the jack member positioned medially of the support boom between the support boom and the engine support plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine hoist and support apparatus which has all the advantages of the prior art engine hoist apparatus and none of the disadvantages.

It is another object of the present invention to provide a new and improved engine hoist and support apparatus which may be easily and efficiently manufactured and marketed.

It is a further object of the present invention to provide a new and improved engine hoist and support apparatus which is of a durable and reliable construction.

An even further object of the present invention is to provide a new and improved engine hoist and support apparatus which is susceptible of a low cost of manufacture with regard to both materials and labor, and which accordingly is then susceptible of low prices of sale to the consuming public, thereby making such engine hoist and support apparatus economically available to the buying public.

Still yet another object of the present invention is to provide a new and improved engine hoist and support apparatus which provides in the apparatuses and methods of the prior art some of the advantages thereof, while simultaneously overcoming some of the disadvantages normally associated therewith.

Still another object of the present invention is to provide a new and improved engine support and hoist apparatus wherein the same permits repositioning of the engine relative to a support boom for mounting of the engine upon a support plate within the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
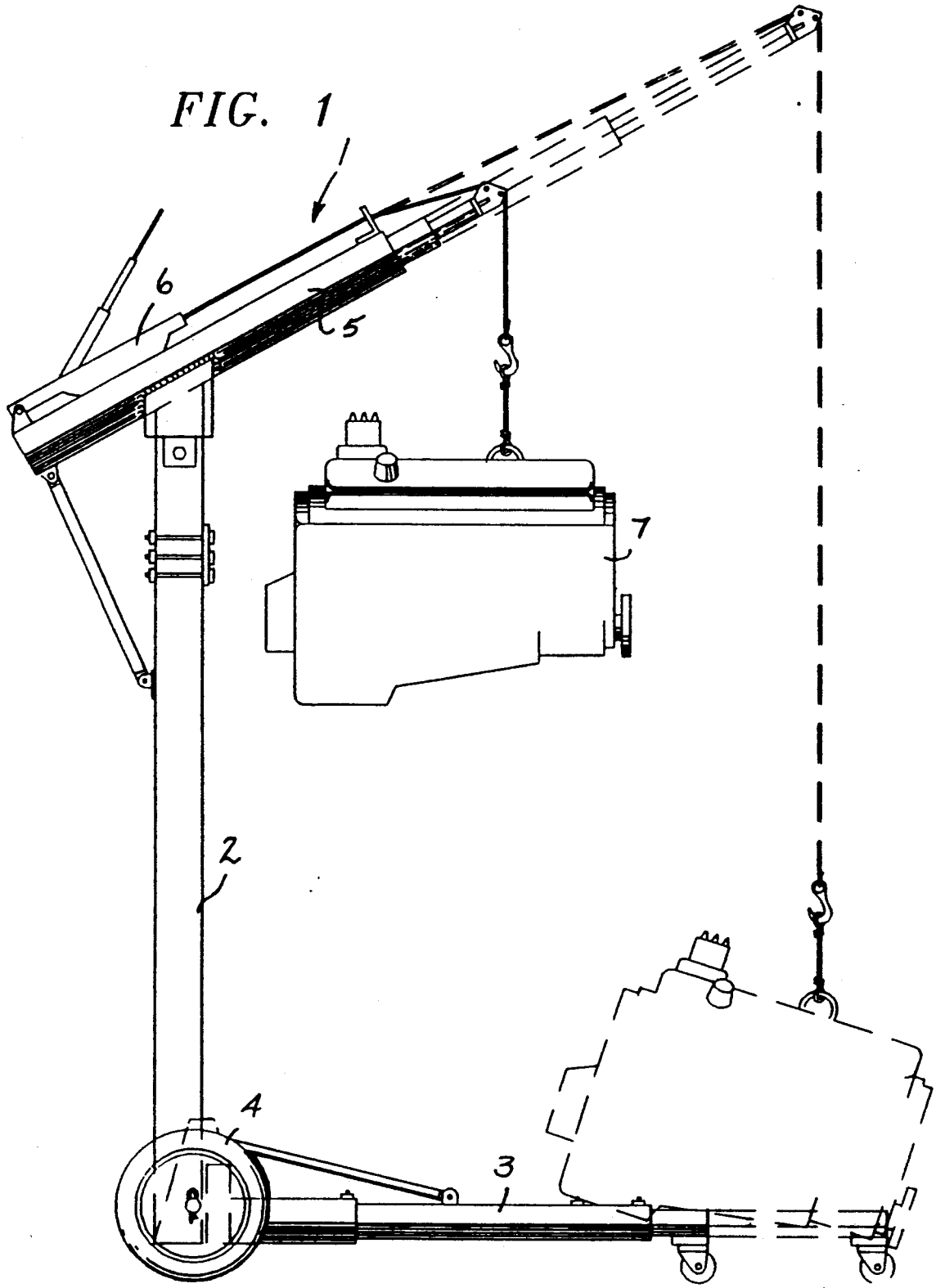
FIG. 1 is an orthographic side view, taken in elevation, of a prior art engine lifting apparatus.
Figure 2:
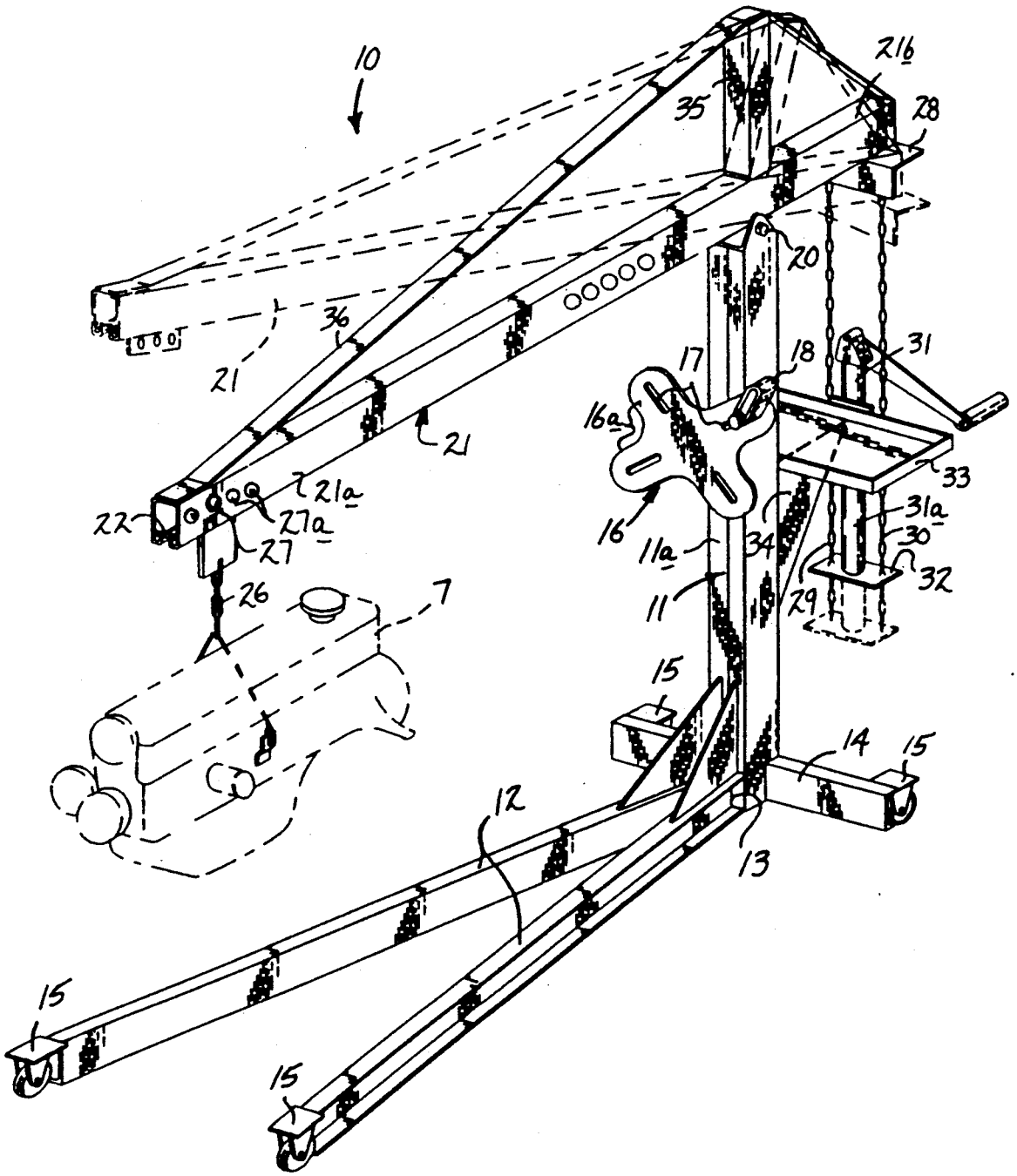
FIG. 2 is an isometric illustration of the instant invention.
Figure 3:
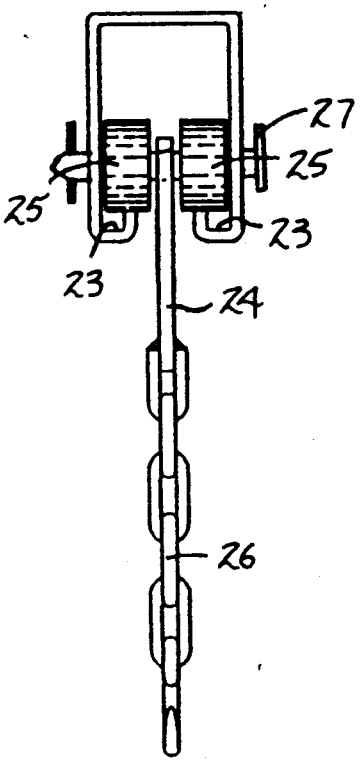
FIG. 3 is an orthographic cross-sectional illustration of the track structure of the instant invention.
Figure 4:
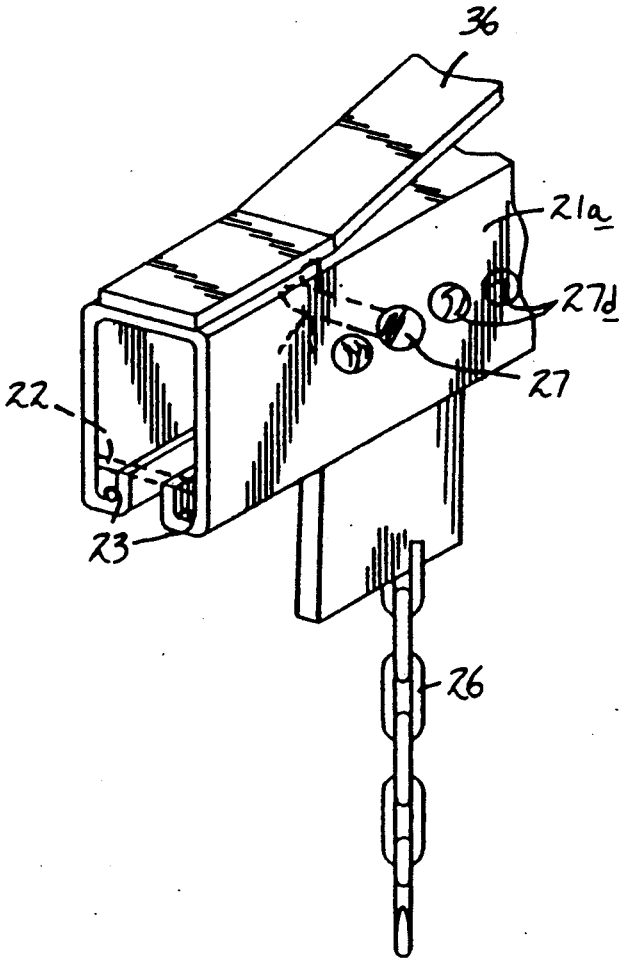
FIG. 4 is an isometric illustration of a forward end of the support boom illustrating the track structure therewithin.
Figure 5:
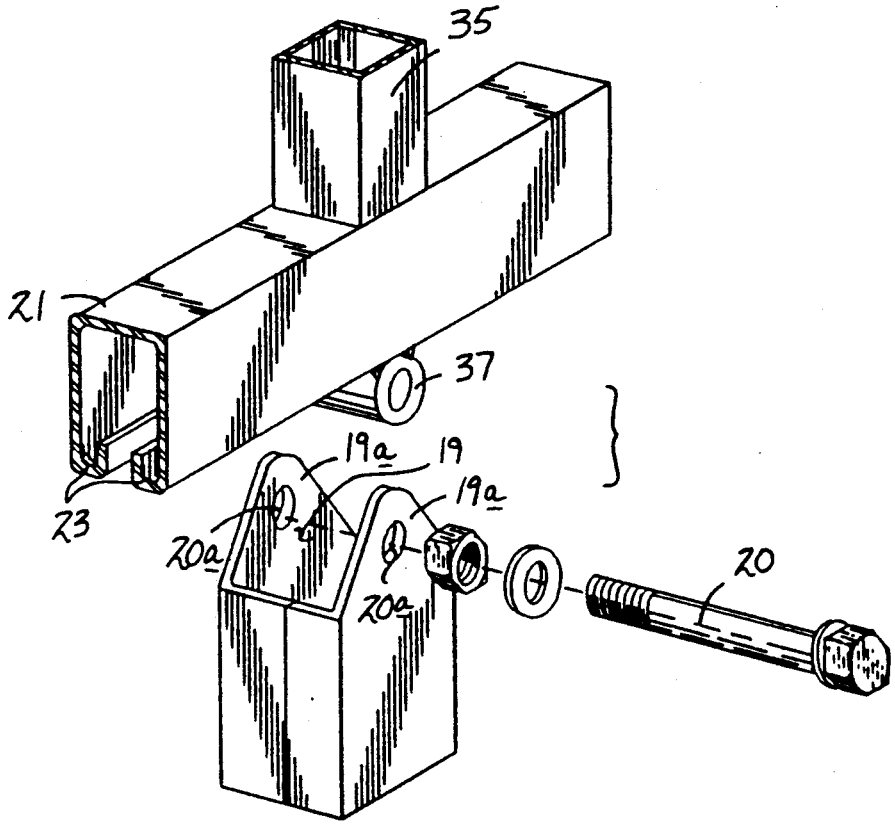
FIG. 5 is an isometric illustration, somewhat exploded, of the pivot relationship of the support boom to the support post.
Figure 6:
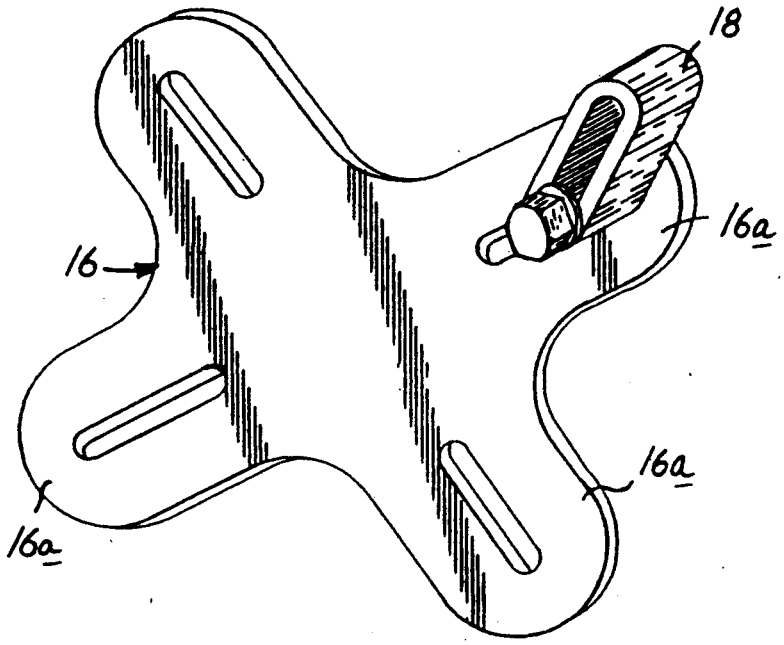
FIG. 6 is an isometric illustration of the engine plate utilized by the instant invention.

With reference now to the drawings, and in particular to FIGS. 1 to 9 thereof, a new and improved engine hoist and support apparatus embodying the principles and concepts of the present invention and generally designated by the reference numerals 10 and 10*a* will be described.

FIG. 1 illustrates a prior art engine hoist apparatus 1, wherein a support boom 2 includes a plurality of telescoping legs 3 mounting transport wheels 4 thereon. A support boom 5 is mounted at an upper end thereof, with the support boom including a jacking member 6 for permitting lifting of the engine 7. The support boom is of a telescoping relationship to permit retraction and repositioning of the engine subsequent to its lifting, as illustrated.

More specifically, the engine hoist and support apparatus 10 of the instant invention essentially comprises a central vertical support post 11, including a vertical forward surface 11*a*, with a plurality of horizontal support legs 12 joined to define an apex 13 and mounted to the forward surface 11*a* at a lower terminal end of the post 11. A lateral horizontal support beam 14 is medially bisected by the post 11 at the lower terminal end thereof, and defines an equal included angle between the support beam 14 and adjacent legs 12. The support beam 14 includes a truck wheel 15 mounted at each terminal end thereof, with each horizontal support leg 12 including a truck wheel 15 mounted at its free terminal end to permit positioning of the organization as required. The use of truck wheels or castor wheels or their equivalent is utilized in the construction of the instant invention.

An engine support plate 16 is mounted to the forward surface 11*a* somewhat medially thereof, with the support plate 16 including a plurality of aligned pairs of legs 16*a*, each including a diametrically aligned slot. Each slot may include an adapter loop 18 and an associated fastener to accommodate various bolt patterns of engines 7 to be mounted thereon. A "U" shaped recess 19 (see FIG. 5) includes a plurality of spaced parallel pivot rod flanges 19*a*, including a pivot rod opening within each flange, wherein the openings 20*a* are diametrically aligned to receive a pivot rod 20 therethrough. The pivot rod 20 is arranged orthogonally relative to a longitudinally aligned support boom 21 pivotally mounted to the "U" shaped recess 19, including a pivot rod cylinder 37 of a predetermined length substantially equal to that defined by a predetermined length defined between the pivot rod flanges 19*a*. The support boom 21 includes a forward portion 21*a* arranged forwardly of the pivot rod 20, and a rear portion 21*b* arranged rearwardly of the pivot rod 20. A plurality of spaced parallel tracks 23 are directed through the floor of the support boom 21 and are arranged generally coextensively with the forward portion 21*a*, with an abutment plate 22 extending about a forward end of the support boom 21 to prevent inadvertent removal of a carriage plate 24 that is longitudinally and rotatably mounted upon the spaced tracks 23. The carriage plate 24 includes a plurality of spaced support wheels 25, with the wheels mounted within each of the spaced tracks to permit ease of longitudinal movement of the carriage plate 24 along the support boom 21. Further, a carriage plate lock pin 27 (see FIG. 3) is inserted in one of the forward multiple holes 27*a* in the support boom 21 to arrest movement of the carriage plate 24. Subsequent to lifting of an engine 7, the carriage plate lock pin 27 is subsequently removed from one of the forward multiple holes 27*a* in the support boom 21 to permit rearward traverse of the carriage plate 24 along the tracks 23 and thereby permit horizontal alignment of the engine 7 with the engine support plate 16. The carriage plate lock pin 27 is then inserted into one of the rearward multiple holes 27*b* in the support boom 21 to arrest movement and position the carriage plate 24 while lowering the engine 7 into vertical alignment with the engine support plate 16.

The rear terminal end or rear portion 21*b* of the support boom 21 includes an upper chain support boom 28 orthogonally and integrally mounted to the rear terminal end of the rear portion 21*b*, with a respective first and second support chain 29 and 30 mounted in a parallel spaced relationship to the upper chain support beam 28 and directed downwardly therefrom and secured to a lower chain support beam 32. The lower chain support beam 32 is integrally and orthogonally mounted to a lower terminal end of extensible and retractable jack leg 31*a* of an associated hydraulic or mechanical jack 31, whereupon extension of the jack leg 31*a* effects pivotment and upward orientation of the forward end of the support boom 21, in a manner as illustrated in phantom in FIG. 2. An accessory tray 33 accommodating various tools and the like is provided between the jack 31 and the support post 11 accommodating various tools and the like and operating upon the engine 7 when mounted upon the engine support plate 16. A tray and jack mount flange 34 provides mounting of the jack 31 and the accessory tray 33 to the support post 11. A support boom leg 35 extending orthogonally and integrally upwardly relative to the support boom 21 overlying the pivot rod cylinder 37 secures a support boom strap 36 that extends from the forward end of the support boom 21 to the rear terminal end to minimize flexing of the support boom 21 in use.

Figure 7:
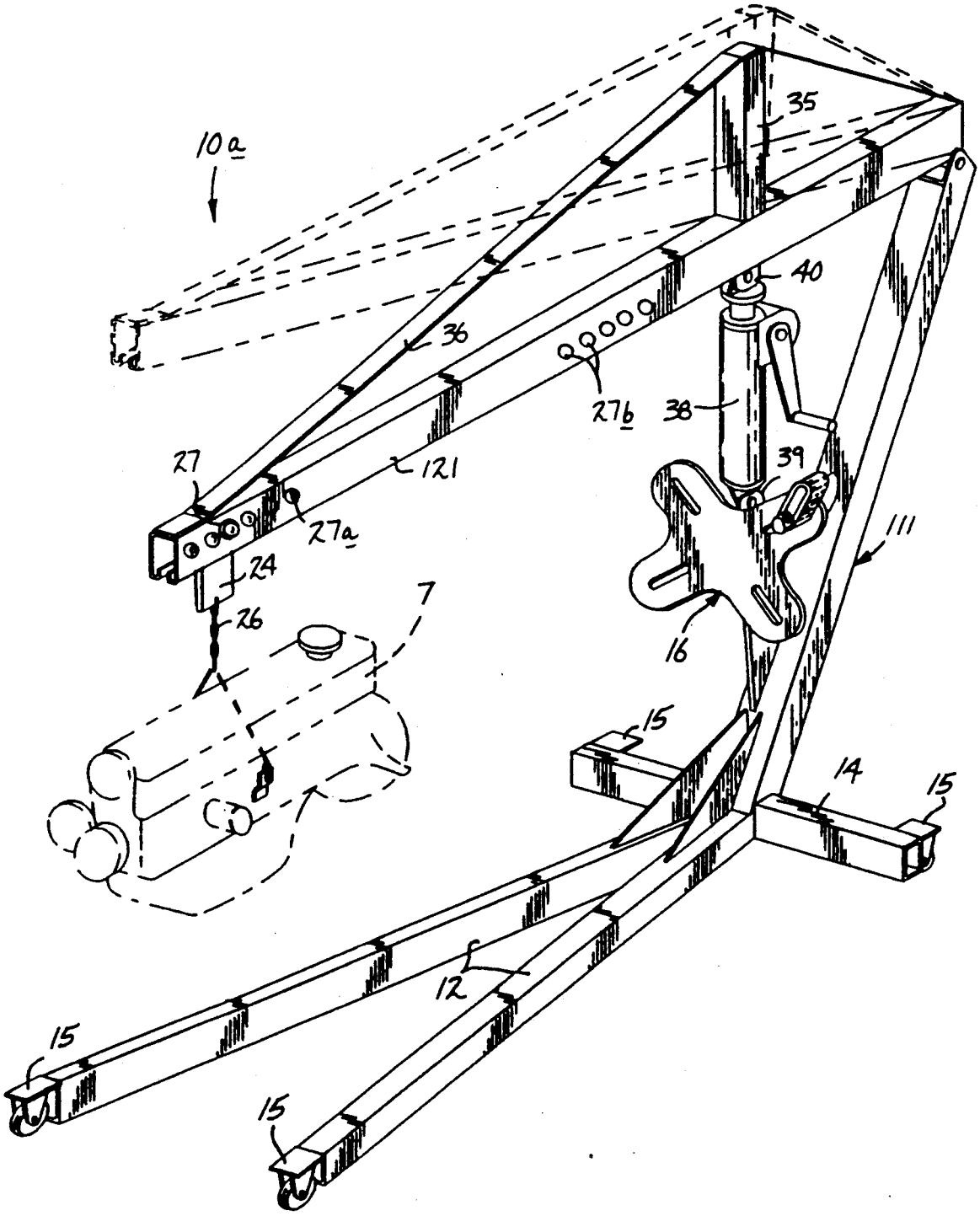
FIG. 7 is an isometric illustration of a modified engine hoist and support apparatus of the instant invention.
Figure 8:
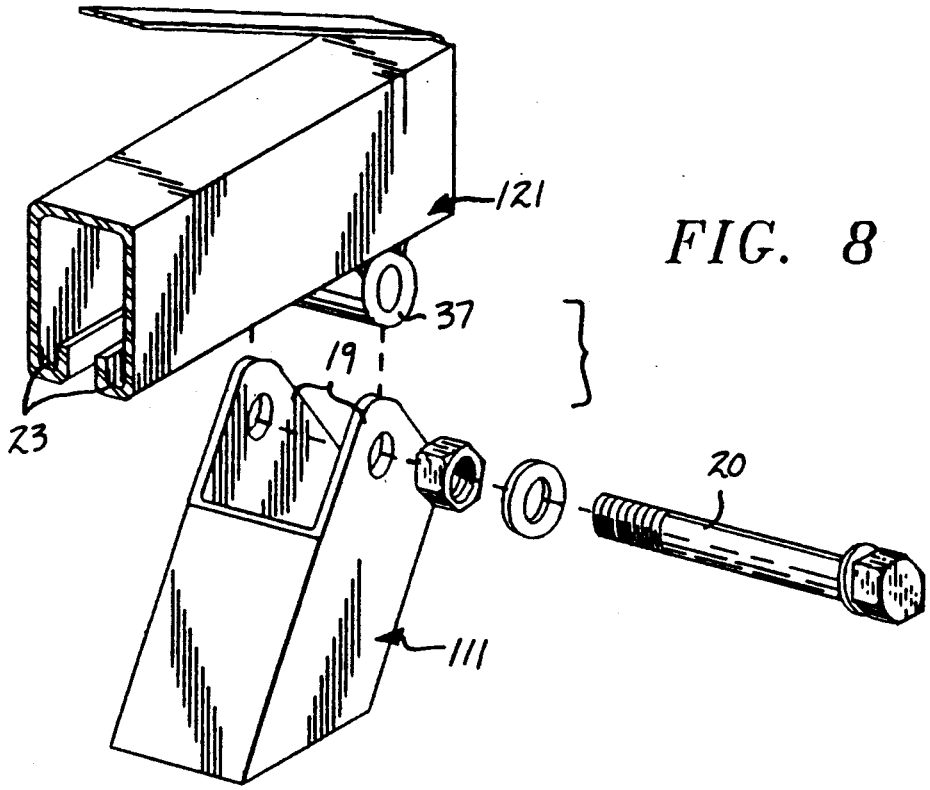
FIG. 8 is an isometric illustration, somewhat exploded, of the pivot construction of the modified apparatus of the instant invention.
Figure 9:
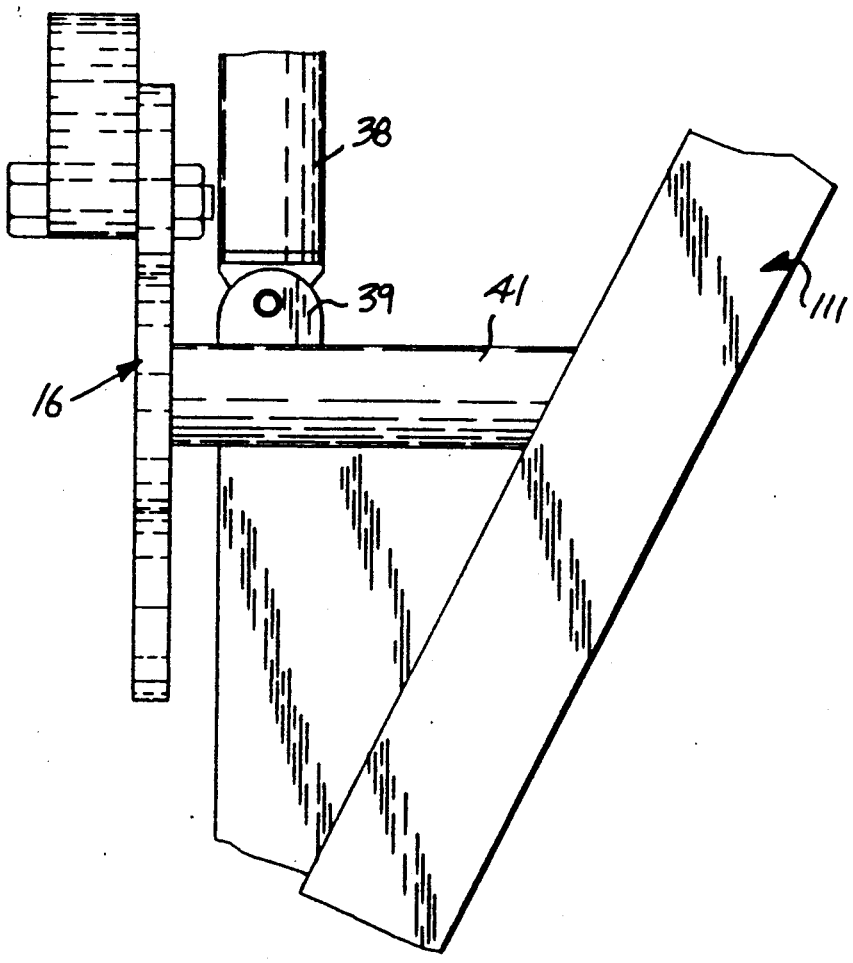
FIG. 9 is an orthographic side view, taken in elevation, of the mounting of the jack structure relative to the support posts of the modification of the instant invention.

FIG. 7 illustrates a modified apparatus 10*a* wherein the central support boom 111 is arranged at an obtuse angle relative to the plural horizontal legs 12, and extends rearwardly to pivotally mount the rear terminal end of the modified support boom 121, with a hydraulic or mechanical jack 38 mounted to a jack support leg 41 at a lower pivot 39 and mounted to the support boom 121 underlying the boom leg 35 at an upper pivot 40, whereupon extension of the jack 38 effects outward pivotment of the modified beam 121.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An engine hoist and support apparatus comprising, a central vertical support post with a lower terminal end, the support post including a forward surface and a rear surface, the forward surface including a plurality of horizontal support legs mounted to the forward surface at the lower terminal end of the support post, and a lateral horizontal support beam integrally mounted and extending laterally of the support post adjacent the support legs, with the support post bisecting the lateral horizontal support beam, and the support post including an upper terminal end defining a "U" shaped recess, the "U" shaped recess including spaced parallel flanges, the spaced parallel flanges defined by a predetermined spacing, and each flange including a flange aperture, wherein the flange apertures are coaxially aligned and adapted to receive a pivot rod therethrough, and a support boom, the support boom including a pivot rod cylinder with a dimension defined by the predetermined spacing between the flanges and rotatably receiving the pivot rod therethrough, the pivot rod being orthogonally oriented relative to the support boom, the support boom including a rear portion extending rearwardly of the pivot rod and a forward portion extending forwardly of the pivot rod, the forward portion of the support beam includes spaced track means, load supporting carriage means adapted to move along said track means, means for selectively securing the carriage means to a first plurality of positions on the support beam adjacent the support post and to a second plurality of positions adjacent the end of the forward portion of the support boom, and jack means mounted to the support post and to the rear portion of the support boom to effect pivotment of the support boom about the pivot rod.

2. An apparatus as set forth in claim 1 wherein the jack means includes an upper chain support beam integrally and orthogonally mounted to the rear portion of the support boom, and further including a first and second chain member mounted to the upper chain support beam, and the jack means further including a jack member, the jack member mounted to the support post spaced from the support post and integrally mounted to a mounting flange, and the jack further including an extensible and retractable leg, with the leg including a lower chain support beam, the lower chain support beam integrally mounting the first and second chain thereto, whereupon extension of the jack leg relative to the jack effects upward pivotment of the forward portion of the support boom relative to the support legs.

3. An apparatus as set forth in claim 2 wherein the flange mounting the jack includes an accessory tray mounted to a top end portion of the support post to mount the accessory tray between the jack and the support post.

4. An apparatus as set forth in claim 3 wherein the the track means includes a plurality of spaced parallel tracks extending coextensively with the forward portion of the support boom and defining a floor of the forward portion, and the carriage means includes a carriage plate, the carriage plate including a plurality of support wheels, the support wheels rotatably mounted upon the spaced parallel tracks to permit longitudinal movement of the carriage plate relative to the spaced parallel tracks.

5. An apparatus as set forth in claim 4 wherein the carriage plate includes a lock pin releasably directed orthogonally therethrough, said first and second plurality of positions includes multiple holes in the support boom, the lock pin being inserted into one of the multiple holes in the support boom and the carriage plate to arrest movement of the carriage plate relative to the spaced parallel tracks and the support boom, the carriage plate slidably positionable to align the carriage plate with a selected one of the holes to permit directing the lock pin through one of said holes and said carriage plate.

6. An apparatus as set forth in claim 5 including an abutment plate integrally mounted overlying the spaced parallel tracks at a forward terminal end of the support boom.

7. An apparatus as set forth in claim 6 including a lift chain mounted to the carriage plate.

8. An apparatus as set forth in claim 7 including a support boom leg integrally and orthogonally mounted to the support boom extending upwardly therefrom and overlying the pivot rod cylinder, and a support boom strap including a forward terminal mounted to the forward portion of the support boom, and a rear terminal to the rear portion of the support boom to minimize flexure of the support boom during use.

9. An apparatus as set forth in claim 8 including an engine support plate mounted to the forward surface of the support post, with the support plate including a plural pair of aligned legs, each leg including a slot, wherein opposed slots are in aligned relationship, and an adapter loop selectively securable to each slot to permit adaption of a plurality of engine bolt patterns to the engine support plate.

* * * * *